US007670194B1

(12) United States Patent
Fitzpatrick

(10) Patent No.: US 7,670,194 B1
(45) Date of Patent: Mar. 2, 2010

(54) RJ-45 STYLE COMMUNICATIONS JACKS HAVING MECHANISMS THAT PREVENT AN RJ-11 STYLE COMMUNICATIONS PLUG FROM BEING FULLY INSERTED WITHIN THE JACK

(75) Inventor: Brian Fitzpatrick, McKinney, TX (US)

(73) Assignee: CommScope, Inc. of North Carolina, Hickory, NC (US)

( * ) Notice: Subject to any disclaimer, the term of this patent is extended or adjusted under 35 U.S.C. 154(b) by 0 days.

(21) Appl. No.: 12/258,690

(22) Filed: Oct. 27, 2008

(51) Int. Cl.
*H01R 13/64* (2006.01)

(52) U.S. Cl. ..... 439/677; 439/680

(58) Field of Classification Search ..... 439/677, 439/680, 676
See application file for complete search history.

(56) References Cited

U.S. PATENT DOCUMENTS

| | | | | |
|---|---|---|---|---|
| 3,614,714 | A | 10/1971 | Silverstein | |
| 4,376,565 | A | 3/1983 | Bird et al. | |
| 4,781,626 | A * | 11/1988 | Lazarchik | 439/680 |
| 5,370,556 | A | 12/1994 | Olsson | |
| 5,387,135 | A | 2/1995 | Shen et al. | |
| 6,186,835 | B1 | 2/2001 | Cheshire | |
| 6,244,907 | B1 | 6/2001 | Arnett | |
| 6,257,935 | B1 | 7/2001 | Zhang et al. | |
| 6,296,528 | B1 * | 10/2001 | Roberts et al. | 439/676 |
| 6,312,293 | B1 | 11/2001 | Wang | |
| 6,319,070 | B1 | 11/2001 | Tan | |
| 6,375,516 | B1 | 4/2002 | Trinh | |
| 6,416,364 | B1 | 7/2002 | Shi et al. | |
| 6,458,001 | B1 | 10/2002 | Chen et al. | |
| 6,641,443 | B1 | 11/2003 | Itano et al. | |
| 6,786,776 | B2 | 9/2004 | Itano et al. | |
| 7,037,141 | B1 * | 5/2006 | Huang | 439/676 |
| 7,114,995 | B1 * | 10/2006 | Ohshima | 439/680 |
| 7,125,288 | B2 | 10/2006 | Schilling | |
| 7,311,562 | B2 | 12/2007 | Leong et al. | |

OTHER PUBLICATIONS

Technical Bulletin, "Retention Force Technology," Leviton, 2007, Circle Card Reader #131.
U.S. Appl. No. 12/016,338, filed Jan. 18, 2008.

* cited by examiner

*Primary Examiner*—Tho D Ta
(74) *Attorney, Agent, or Firm*—Myers Bigel Sibley & Sajovec

(57) ABSTRACT

RJ-45 style communications jacks include a housing having a plug receiving cavity, a guide protruding from a first surface of the housing into the plug receiving cavity and a stop provided at a second surface of the housing. The guide is configured to contact a plug housing of an RJ-11 communications plug when the RJ-11 communications plug is inserted within the plug receiving cavity so that the guide directs the RJ-11 communications plug toward the second surface where the stop prevents the RJ-11 communications plug from being fully inserted within the plug receiving cavity.

22 Claims, 11 Drawing Sheets

RJ-45 STYLE COMMUNICATIONS JACKS HAVING MECHANISMS THAT PREVENT AN RJ-11 STYLE COMMUNICATIONS PLUG FROM BEING FULLY INSERTED WITHIN THE JACK

FIELD OF THE INVENTION

The present invention relates generally to communications connectors and, more particularly, to RJ-45 style communications jacks.

BACKGROUND

Many hardwired communications systems use plug-jack connectors to connect a communications cable to another communications cable or to a piece of equipment such as a computer, printer, server, switch or patch panel. By way of example, high speed communications systems routinely use such plug-jack connectors to connect computers, printers and other devices to local area networks and/or to external networks such as the Internet. FIG. 1 depicts a simplified example of such a hardwired high speed communications system that illustrates how plug-jack connectors may be used to interconnect a computer 1 to, for example, a network server 10.

As shown in FIG. 1, the computer 1 is connected by a cable 2 to a communications jack 5 that is mounted in a wall plate 9. The cable 2 is a patch cord that includes a communications plug 3, 4 at each end thereof. Typically, the cable 2 includes a plurality of wire conductors (e.g., eight), which are arranged in pairs so that each pair of conductors may carry a separate differential signal. Communications plug 3 inserts into a communications jack (not pictured in FIG. 1) provided in the back of the computer 1. Communications plug 4 inserts into an opening or "plug aperture" 6 in the front side of the communications jack 5 so that the contacts of the communications plug 4 mate with respective contacts of the communications jack 5 (if the cable 2 includes eight conductors, the communications plugs 3, 4 and the communications jack 5 will typically each have eight contacts). The communications jack 5 includes a wire connection assembly 7 at the back end thereof that receives a plurality of conductors (e.g., eight) from a second cable 8 that are individually pressed into slots in the wire connection assembly 7 to establish mechanical and electrical connections between each conductor of the second cable 8 and a respective one of a plurality of conductive paths through the communications jack 5. The other end of the second cable 8 is connected to a network server 10 which may be located, for example, in a telecommunications closet of a commercial office building. Thus, the patch cord 2, the cable 8 and the communications jack 5 provide a plurality of electrical paths (e.g., four differential signal paths) between the computer 1 and the network server 10. Each of these electrical paths may be used to communicate electrical information signals between the computer 1 and the network server 10. It will be appreciated that typically one or more patch panels or switches, along with additional communications cabling, would be included in the electrical path between the second communications cable 8 and the network server 10. However, for ease of description, these additional elements have been omitted from FIG. 1 and the second communications cable 8 is instead shown as being directly connected to the network server 10.

In order to provide standardization between the high speed communications equipment marketed and sold by different vendors, industry standards documents have been promulgated that specify various mechanical and electrical properties for communications jacks and plugs. One example of such a standard is the TIA/EIA-568-B.2-1 standard that was approved on Jun. 20, 2002 by the Telecommunications Industry Association. These industry standard documents typically incorporate, by reference, interface and wiring standards that specify, among other things, the dimensions and configurations of various types of standardized communications plugs and jacks so that industry standards-compliant plugs and jacks sold by different vendors will work with each other.

By way of example, the above-referenced TIA/EIA-568-B.2-1 standard requires compliance with interface specifications set forth in the FCC Part 68.500 document, which defines, among other things, the dimensions and configurations for various plug-jack interfaces, including plugs and jacks that conform to the Registered Jack 45 ("RJ-45") wiring standard and plugs and jacks that conform to the Registered Jack 11 ("RJ-11") wiring standard. The RJ-45 wiring standard describes wiring specifications for eight wire connector assemblies (including plugs and jacks) that are commonly used, for example, in Ethernet networks to connect computers and other hardware to local area networks (LAN) and/or the Internet, as is discussed above with respect to FIG. 1. The RJ-11 wiring standard, on the other hand, describes wiring specifications for four and six wire connector assemblies that are used in the United States primarily to connect telephone equipment. Herein, a plug or jack that substantially complies with the RJ-11 wiring standard is referred to as an "RJ-11" or "RJ-11 style" communications plug or jack, and a plug or jack that substantially complies with the RJ-45 wiring standard is referred to as an "RJ-45" or "RJ-45 style" communications plug or jack.

FIG. 2A is a simplified perspective view of an RJ-45 style communications jack 20, and FIG. 2B is a simplified plan view of an RJ-45 style communications plug 30. FIG. 4 is a perspective view of the RJ-45 style communications plug 30. As shown in FIG. 2A, RJ-45 jack 20 includes eight resilient jackwire contacts 21-28, which are mounted so that they extend into a plug receiving cavity 29. As shown in FIGS. 2B and 4, the RJ-45 communications plug 30 includes eight plug contacts 31-38, which are often referred to as "blades." The plug contacts 31-38 are received within contact slots 31'-38' that are provided in the top surface of the housing 39 of RJ-45 communications plug 30 (each contact slot 31'-38' also extends into the front surface of RJ-45 communications plug 30). The contact slots 31'-38' on RJ-45 communications plug 30 are positioned so that when the plug 30 is inserted into RJ-45 communications jack 20, the contact slots 31'-38' are aligned with plug contact regions of respective ones of jackwire contacts 21-28. Thus, when the RJ-45 communications plug 30 is inserted into the plug receiving cavity 29 of RJ-45 communications jack 20, the plug blades 31-38 make mechanical and electrical connection with respective ones of the jackwire contacts 21-28. The plug-jack interface is designed so that, as the plug 30 is inserted into plug receiving cavity 29, the blades 31-38 of the RJ-45 communications plug 30 engage their respective contacts 21-28 and deflect them back and/or upward a short distance. The resiliency of the jackwire contacts 21-28 creates a "contact force" that holds the jackwire contacts 21-28 in firm engagement with their respective plug blades 31-38. When the RJ-45 communications plug 30 is removed, the jackwire contacts 21-28 move downwardly and/or forwardly back into their normal resting position.

FIG. 3A is a simplified perspective view of a six contact RJ-11 communications jack 40, and FIG. 3B is a simplified plan view of a six contact RJ-11 communications plug 50. As shown in FIG. 3A, the RJ-11 communications jack 40 includes six jackwire contacts 42-47, which are mounted so that they extend into a plug receiving cavity 49. As shown in FIG. 3B, the RJ-11 communications plug 50 includes six plug contacts 52-57. The plug blades 52-57 are received within contact slots 52'-57' on the top surface of the housing 59 of RJ-11 communications plug 50. The contact slots 52'-57' on RJ-11 communications plug 50 are positioned so that when the plug 50 is inserted into RJ-11 communications jack 40, the contact slots 52'-57' are aligned with plug contact regions of respective ones of the jackwire contacts 42-47. The RJ-11 communications plug 50 and jack 40 work together in the same manner, described above, that the RJ-45 communications plug 30 and jack 20 work together. An RJ-11 communications plug with four contacts does not contain contacts 52 and 57, but does include the contact slots 52' and 57'. As the differences between four contact and six contact RJ-11 plugs are immaterial to this description, the remainder of this specification will focus on six contact RJ-11 communications plugs.

As is evident from FIGS. 2-4, RJ-45 connector assemblies (i.e., plugs and jacks) look very similar to RJ-11 connector assemblies, except that RJ-45 communications plugs and jacks are slightly wider than RJ-11 communications plugs and jacks and include at least two more contacts. Moreover, telephone and facsimile lines that are wired using RJ-11 style communications plugs and jacks are often located in the telecommunications closet of a building in close proximity to Ethernet equipment that is wired using RJ-45 plugs and jacks. Due to the visual similarities between the RJ-11 and RJ-45 connector assemblies, and their close proximity in many telecommunications closets, all too often, the slightly narrower RJ-11 communications plugs are inserted into RJ-45 communications jacks.

Unfortunately, when an RJ-11 communications plug is inserted into an RJ-45 communications jack, the RJ-45 communications jack can be damaged. This can best be seen with reference to FIG. 5, which is a cross-sectional diagram taken along line 5-5 of FIG. 4. As shown in FIG. 5, the vertical height of the housing 39 of plug 30 is about 0.260". However, the plug blades 31-38 that are mounted in the contact slots 31'-38' do not extend all the way to the top of housing 39. Accordingly, the effective height of the housing 39 along respective ones of the contact slots 31'-38' is somewhat less (approximately 0.023" less) than the height of the housing 39. The same is true with respect to the RJ-11 plug 50 of FIG. 3B, namely the height of the housing 59 of plug 50 is approximately 0.260", while the distance from the top edge of each plug blade 52-57 to the bottom of the housing 59 is only about 0.237".

When RJ-11 communications plug 50 is inserted into RJ-45 communications jack 20, the forward and top surfaces of the housing 59 of the plug 50 engage jackwire contacts 21 and 28 of jack 20, as the six blade RJ-11 communications plug 50 does not include contact slots or plug blades in the outside two contact positions (i.e., the major difference between the six contact RJ-11 communications plug 50 and the RJ-45 communications plug 30 is that the RJ-11 communications plug 50 does not include slots 31' and 38' and contacts 31 and 38 that are included on the RJ-45 communications plug 30). As the housing 59 of RJ-11 communications plug 50 (as opposed to contacts of plug 50), which has the full height of 0.260", engages the outside jackwire contacts 21 and 28, the jackwire contacts 21 and 28 of jack 20 are over-deflected by 0.023" when RJ-11 communications plug 50 is accidentally inserted into RJ-45 communications jack 20 (as compared to when an RJ-45 plug is inserted). Unless the jackwire contacts 21 and 28 of jack 20 are specially designed to accommodate this additional amount of deflection, the jackwire contacts 21 and 28 may become permanently set in this over-deflected position if RJ-11 communications plug 50 is inserted into RJ-45 communications jack 20 (i.e., the contacts lose some or all of their ability to spring back into their resting position). If this occurs, when an RJ-45 communications plug 30 is later inserted into the RJ-45 communications jack 20, the "contact force" needed to keep blades 31 and 38 of the RJ-45 communications plug 30 in abutment with the respective jackwire contacts 21 and 28 of the RJ-45 communications jack 20 may not be present (or may be insufficient), which may result in poor performance. When insufficient contact force is present, the RJ-45 communications jack 20 may also fail to pass certain tests in the industry standards such as, for example, a specified minimum contact resistance that must be maintained between each plug blade and its respective jackwire contact after a minimum number of plug insertions and removals and under various environmental conditions (e.g., temperatures, relative humidity, etc.).

SUMMARY

Pursuant to embodiments of the present invention, communications jacks are provided with features that facilitate, for example, usability of RJ-45 communications jacks with RJ-45 communications plugs after RJ-11 communications plugs have been used in the RJ-45 communications jacks.

Pursuant to certain embodiments of the present invention, RJ-45 style communications jacks are provided which include a housing having a plug receiving cavity, a guide protruding from a first surface of the housing into the plug receiving cavity and a stop provided at a second surface of the housing. The guide is configured to contact a plug housing of an RJ-11 communications plug when the RJ-11 communications plug is inserted within the plug receiving cavity so that the guide directs the RJ-11 communications plug toward the second surface where the stop prevents the RJ-11 communications plug from being fully inserted within the plug receiving cavity.

In some embodiments of these jacks, the second surface of the housing may be opposite the first surface. The guide may be positioned to be longitudinally aligned with one of the outside blades of an RJ-45 style communications plug when the RJ-45 style communications plug is received within the plug receiving cavity. At least a portion of a surface of the guide that faces a front opening into the plug receiving cavity may be angled or curved. The stop may be a structure that forms a back wall of a recessed region in the second surface of the housing.

In some embodiments, the surface of the guide that faces the front opening into the plug receiving cavity may be configured to engage a leading edge of the plug housing of the RJ-11 style communications plug when the RJ-11 style communications plug is received within the plug receiving cavity. The guide may be further configured to be aligned with a contact slot on an RJ-45 style communications plug when the RJ-45 style communications plug is received within, the plug receiving cavity. In some embodiments, the jack may further include a second guide and/or a second stop.

Pursuant to further embodiments of the present invention, RJ-45 style communications jacks are provided which include a housing having a jack frame that has a top wall, a bottom wall and first and second side walls that define a plug receiving cavity. A guide extends from an interior surface of the top wall into the plug receiving cavity. A stop is formed in the bottom wall. In some embodiments, the guide may be configured to contact a leading surface of an RJ-11 communications plug when the RJ-11 communications plug is inserted within the plug receiving cavity and to guide the RJ-11 communications plug into a recess that is adjacent to the stop to prevent the RJ-11 communications plug from being fully inserted within the plug receiving cavity.

Pursuant to still further embodiments of the present invention, RJ-45 style communications jacks are provided that include an RJ-45 style jack frame having a plug receiving cavity, a first protrusion and a second protrusion that are spaced apart from each other and that extend from a first interior surface of the jack frame into the plug receiving cavity, and a first recess in a second interior surface of the jack frame that is opposite the first interior surface. In these jacks, the first and second protrusions may be configured to contact a plug housing of an RJ-11 communications plug when the RJ-11 communications plug is inserted within the plug receiving cavity so that the first and second protrusions direct the RJ-11 communications plug toward the second surface and into the first recess. The first and second protrusions may each have a width that is less than the width of a contact slot on an RJ-45 style communications plug, and the first and second protrusions may be positioned to be longitudinally aligned with a respective one of the outside contact slots of an RJ-45 style communications plug when the RJ-45 style communications plug is received within the plug receiving cavity.

DETAILED DESCRIPTION

Figure 1:
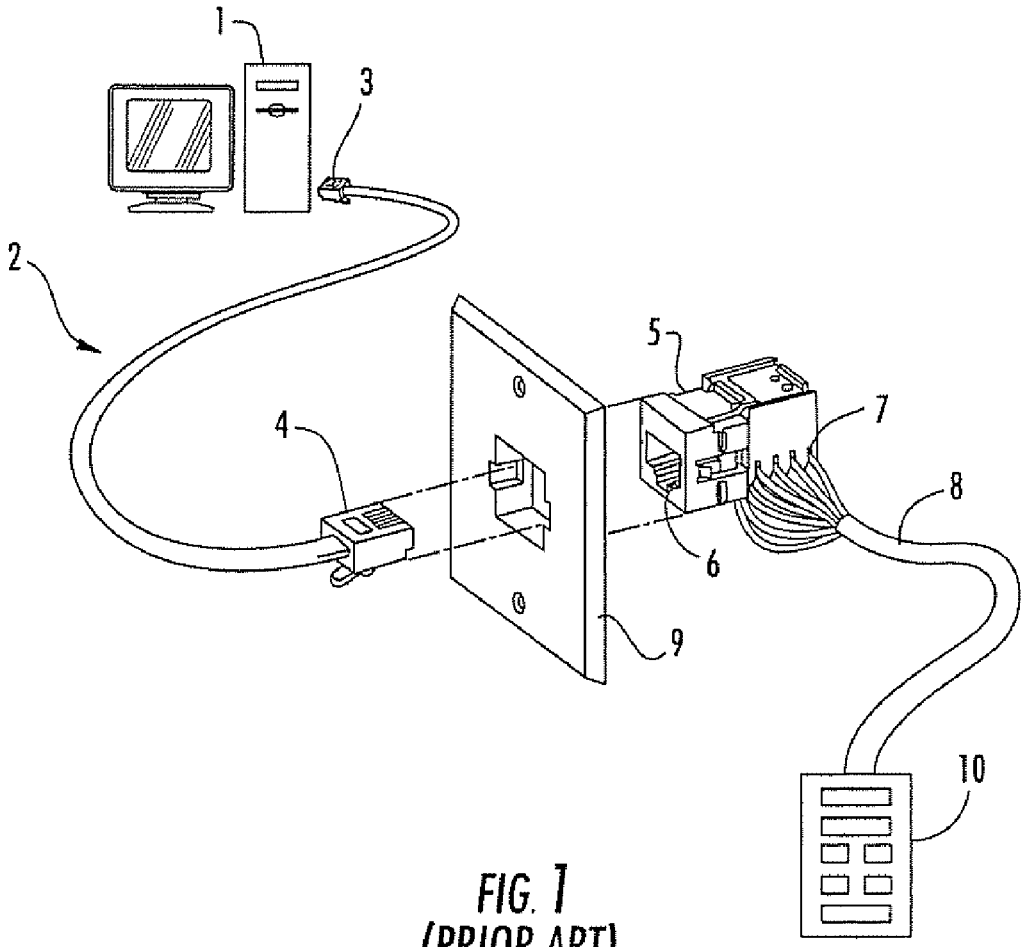
FIG. 1 (PRIOR ART)
FIG. 1 is a simplified schematic diagram illustrating the use of conventional communications plugs and jacks to interconnect a computer with network equipment.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as "top", "bottom", "side" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 6:
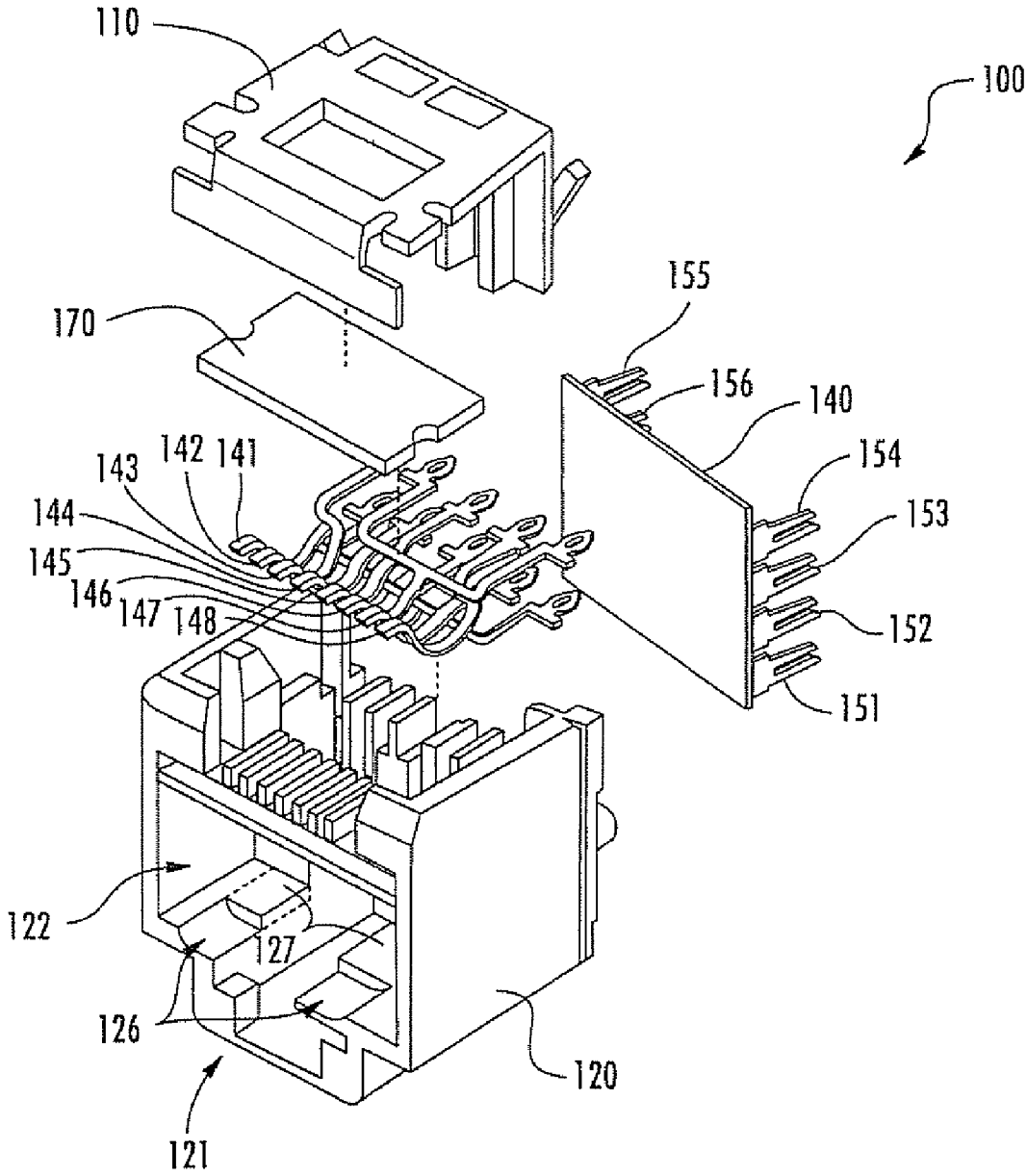
FIG. 6 is an exploded perspective view of an RJ-45 communications jack according to embodiments of the present invention.

FIG. 6 is an exploded perspective view of an RJ-45 communications jack 100 according to certain embodiments of the present invention. As shown in FIG. 6, the jack 100 includes a housing 110, 120, a plurality of jackwire contact wires 141-148, a vertically-oriented wiring board 140, plurality of wire connection terminals 151-158 (only wire connection terminals 151-156 are visible in FIG. 6) and a horizontally-oriented wiring board 170.

As shown in FIG. 6, the housing is a multi-piece housing that comprises a top cover 110 and a jack frame 120. The housing will also typically include a terminal cover (not shown in FIG. 6) that covers and protects the wire connection terminals 151-158 provided at the back end of communications jack 100. The jack frame 120, top cover 110 and the terminal cover may be made of a suitable insulative plastic material that meets all applicable standards with respect to, for example, electrical breakdown resistance and flammability. Typical materials include, but are not limited to, polycarbonate, ABS, and blends thereof. While communications jack 100 includes a specific multi-piece housing, it will be appreciated that the housing may be any conventional or unconventional housing structure, and may comprise a one-piece housing in some embodiments. The jack frame 120 includes a front opening or "plug aperture" 121 that provides access to a plug receiving cavity 122. While the term "plug aperture" is sometimes used in the art to refer to the front opening of a jack frame and/or the cavity within the jack frame that receives the mating plug, herein, for clarity, the term "plug aperture" is used to refer to the opening in the front face of the jack frame 120 and the term "plug receiving cavity" is used to refer to the cavity behind the plug aperture 121 that receives a mating plug. The jack frame 120 will be discussed in greater detail below with respect to FIGS. 7 and 8 which more clearly illustrate features of jack frame 120 which prevent the accidental full insertion of RJ-11 style communications plugs into communications jack 100.

As shown in FIG. 6, top cover 110 protects the horizontally-oriented wiring board 170 as well as the eight jackwire contacts 141-148 that are mounted beneath the horizontally oriented wiring board 170 so as to extend into the plug receiving cavity 122. The vertically oriented wiring board 140 is mounted on the back of the jack frame 120, and each of the eight jackwire contacts 141-148 are mounted in the vertically-oriented wiring board 140 in a conventional fashion such as, for example, by press-fitting the compliant pin terminations of each jackwire contact into a respective metal-plated hole (not shown in FIG. 6) of the wiring board 140. A plurality of wire connection terminals 151-158 (which are implemented as insulation displacement contacts or "IDCs" in the jack of FIG. 6) are mounted on the side of the vertically-oriented wiring board 140 that is opposite the side of the wiring board in which the eight jackwire contacts 141-148 are mounted. Each of the IDCs 151-158 is connected to a respective one of the jackwire contacts 141-148 via conductive traces/paths on the vertically-oriented wiring board 140.

The vertically-oriented wiring board 140 may comprise any type of substrate that includes the above-referenced conductive paths that connect each jackwire contact 141-148 to a respective one of the wire connection terminals 151-158. The vertically-oriented wiring board 140 may also include electrical circuit components or devices arranged on or within the board to compensate for crosstalk that may otherwise be present in the jack 100 and/or in an associated plug that mates with the jack 100. Such devices include, but are not limited to, closely spaced wire traces printed on or within layers of the vertically-oriented wiring board 140 (including, for example, side-by-side conductive trace segments and overlying conductive trace segments), plate capacitors implemented on two or more layers or surfaces of the board, interdigitated finger capacitors such as the interdigitated finger capacitors disclosed, for example, in U.S. Pat. No. 5,997,358, and discrete electrical components such as inductors, capacitors or resistors that are mounted on or within the wiring board 140.

As is also shown in FIG. 6, the jackwire contacts 141-148 are cantilevered from the rear of communications jack 100 toward the front of communications jack 100 so as to extend into the plug receiving cavity 122. Herein, the term "contact", when used as a noun, refers to an electrically conductive element that is designed to establish physical and electrical contact with an electrically conductive element on another device. The jackwire contacts 141-148 depicted in FIG. 6 are one such type of contact that is known in the art. The contacts 141-148 are referred to as "jackwire" contacts because the contacts are configured to resiliently deflect from a resting position when contacted by a mating plug, and then recover or "spring back" to the resting position when the mating plug is removed. Each contact 141-148 includes a plug contact region that is configured to make mechanical and/or electrical contact with a blade of a communications plug that is inserted into the communications jack 100. Each jackwire contact 141-148 may be formed, for example, of a copper alloy such as spring-tempered phosphor bronze, beryllium copper, or the like. A typical cross-section of each jackwire contact 141-148 is 0.017 inch wide by 0.010 inch thick, although other sized and/or shaped (e.g., round) contacts may be used.

As shown in FIG. 6, some of the contacts include a "crossover" in that one contact crosses over or under another contact when the jackwire contacts are viewed from above when the jack is oriented as shown in FIG. 6. Additionally, two of the contacts also include a support beam that is mounted into the vertically-oriented wiring board 140. While the contacts 141-148 of the embodiment depicted in FIG. 6 show one possible jackwire contact configuration, it will be appreciated that essentially any contact configuration will work with embodiments of the present invention. Accordingly, the jackwire contacts 141-148 may have the same or different profiles, may or may not be generally aligned in a side-by-side relationship (except to the extent that general alignment is required in the plug contact region of the contacts to conform to industry standards), may or may not include crossovers, may have different numbers of crossovers, may have staggers where they enter the circuit board, may be cantilevered from the front, etc.

As shown in FIG. 6, the horizontally-oriented wiring board 170 is positioned above the distal or "free" ends of the contact wires 141-148 and beneath the top cover 110. The bottom side of the wiring board 170 has a plurality of contact pads arrayed adjacent to a front edge thereof (not visible in FIG. 6). These contact pads are operatively aligned with corresponding ones of the free ends of some of the contact wires 141-148. Capacitance elements for providing capacitive crosstalk compensation (not shown) are provided on or within layers of the wiring board 170 which are connected to corresponding pairs of the contact pads. When a mating RJ-45 communications plug is received within the plug receiving cavity 122 of jack frame 120, the blades of the plug engage the free ends of the contact wires 141-148 and urge the free ends upward where they mate with a corresponding one of the contact pads on the wiring board 170. Capacitive coupling is thus produced at the non-current carrying free ends of various of the contact wires 141-148 to compensate for offending crosstalk introduced by the mating plug. It should be noted that, in other embodiments, the horizontally-oriented wiring board 170 may be omitted. In embodiments that omit the horizontally-oriented wiring board 170, additional capacitive and/or inductive crosstalk compensation may be provided on, for example, the vertically-oriented wiring board 140.

Figure 2A:
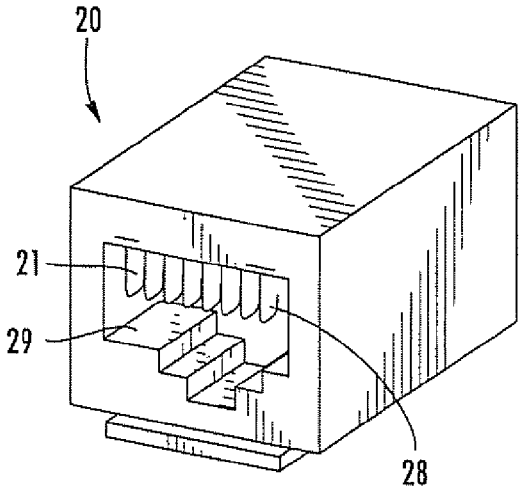
FIG. 2A (PRIOR ART)
FIG. 2A is a simplified perspective view of a conventional RJ-45 communications jack.
Figure 2B:
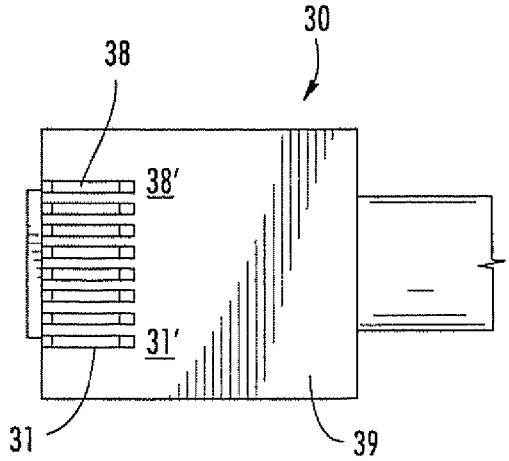
FIG. 2B (PRIOR ART)
FIG. 2B is a simplified plan view of a conventional RJ-45 communications plug.
Figure 4:
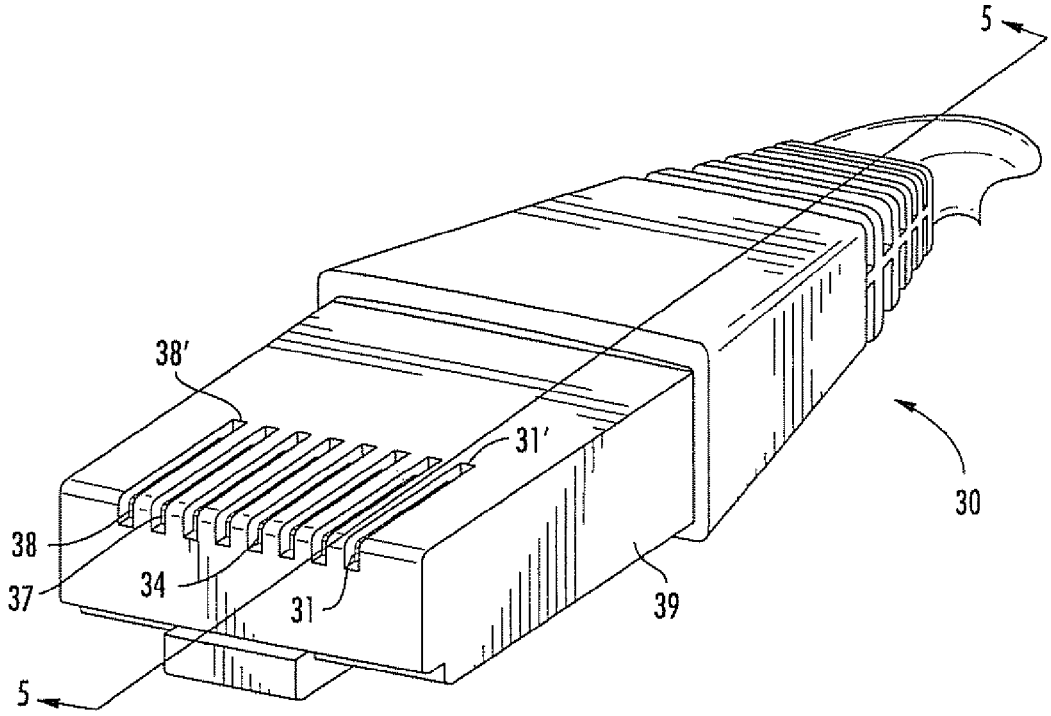
FIG. 4 (PRIOR ART)
FIG. 4 is a perspective view of the conventional RJ-45 communications plug of FIG. 2B.
Figure 5:
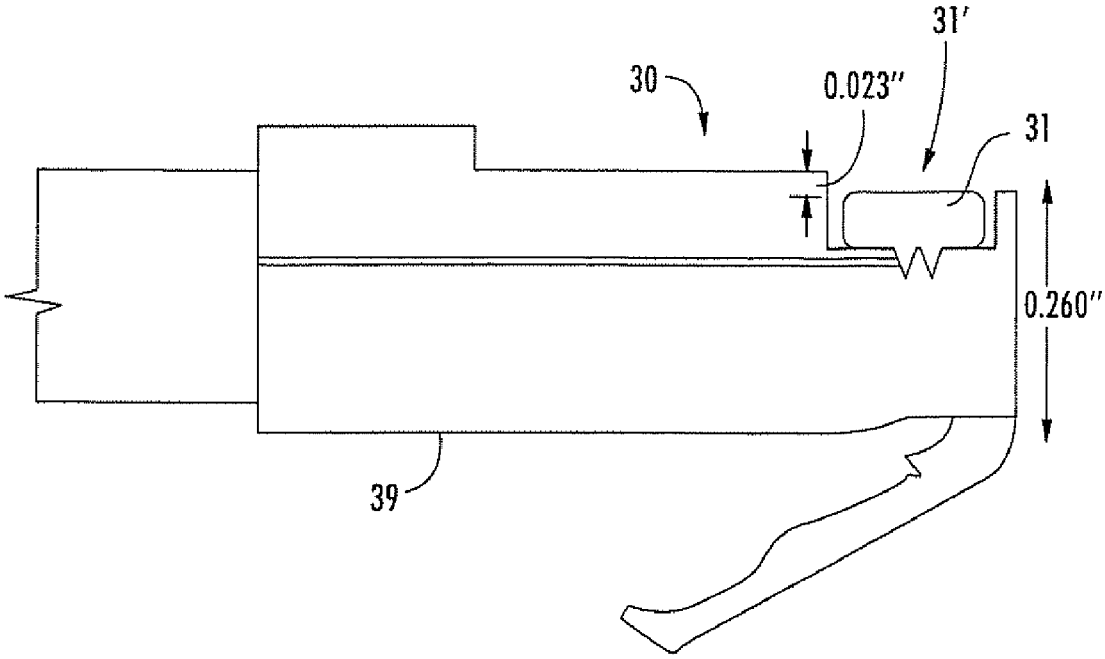
FIG. 5 (PRIOR ART)
FIG. 5 is a cross-sectional view of the RJ-45 communications plug of FIG. 4 taken along the line 5-5 thereof.

As noted above, the plug receiving cavity 122 of communications jack 100 is configured to receive, through plug aperture 121, the front portion of the housing of RJ-45 style communications plug. As discussed above with respect to FIGS. 2B and 4, an RJ-45 communications plug includes eight plug contacts or "blades" which are received within contact slots on the front and/or bottom surface of the plug housing. The contact slots on the plug are positioned so that when the plug is inserted into communications jack 100, the plug contact slots are aligned with plug contact regions of respective ones of jackwire contacts 141-148. Thus, when the RJ-45 communications plug is inserted into the plug receiving cavity 122 of communications jack 100, the plug blades make mechanical and electrical connection with respective ones of the jackwire contacts 141-148.

As discussed above, when an RJ-11 communications plug (e.g., plug 50 of FIG. 3B) is inserted into the RJ-45 communications jack 100 of FIG. 6, the housing of the RJ-11 plug engages contacts 141 and 148 of jack 100, while the blades of the RJ-11 plug engage jackwire contacts 142-147, respectively. As the plug housing nominally extends 0.023" higher vertically than the plug contacts, jackwire contacts 141 and 148 would be deflected beyond their normal deflected positions (i.e., beyond their deflected positions when an RJ-45 communications plug is inserted into the RJ-45 communications jack 100) were the RJ-11 plug fully inserted within the communications jack 100. As indicated above, contacts 141 and 148 of RJ-45 communications jack 100 would be susceptible to becoming permanently deformed as a result of this additional deflection after the RJ-11 plug has been removed.

In order to ensure that contacts 141 and 148 will exert sufficient contact force even after the accidental insertion of an RJ-11 communications plug into RJ-45 communications jack 100, the jack 100 includes a mechanism that prevents the RJ-11 communications plug from being fully inserted into the plug receiving cavity of jack 100. As shown in FIG. 6 and as is discussed in detail with respect to FIGS. 7-9 below, in some embodiments, this mechanism may comprise one or more guides and stops.

Figure 7:
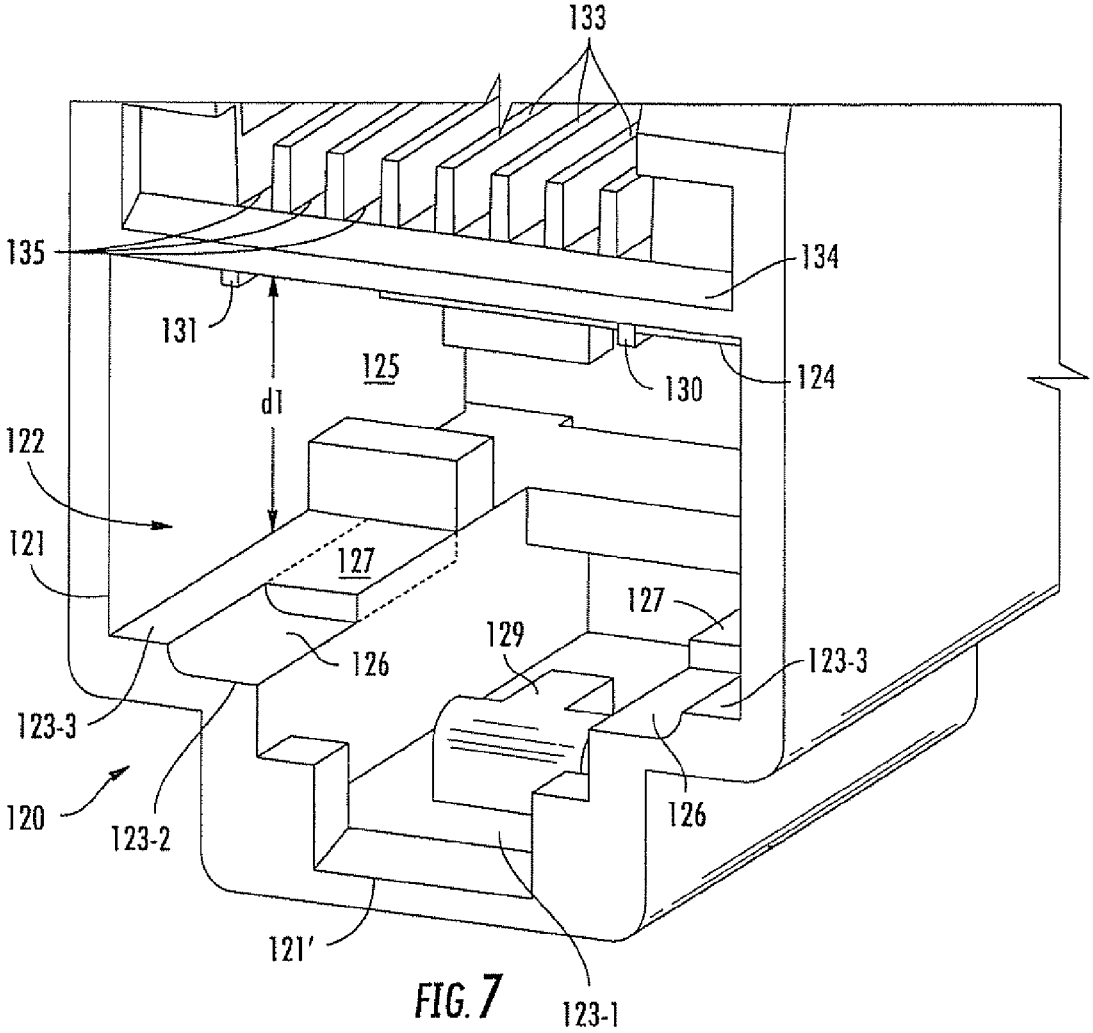
FIG. 7 is an enlarged perspective view of the jack frame of the communications jack of FIG. 6.
Figure 8:
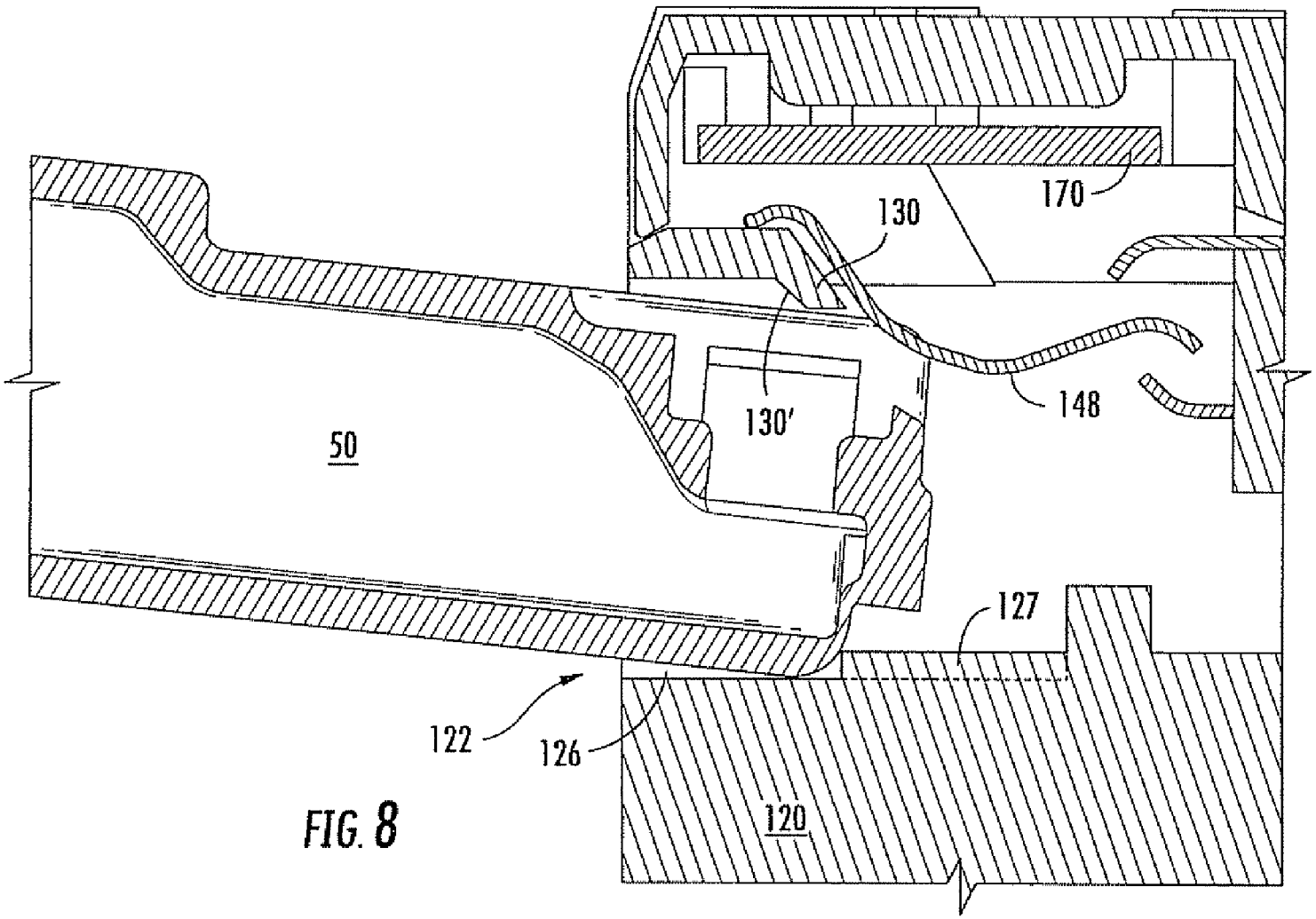
FIG. 8 is a cross-sectional view of the jack frame of the communications jack of FIG. 6 with an RJ-11 communications plug partially inserted into the jack frame.
Figure 9:
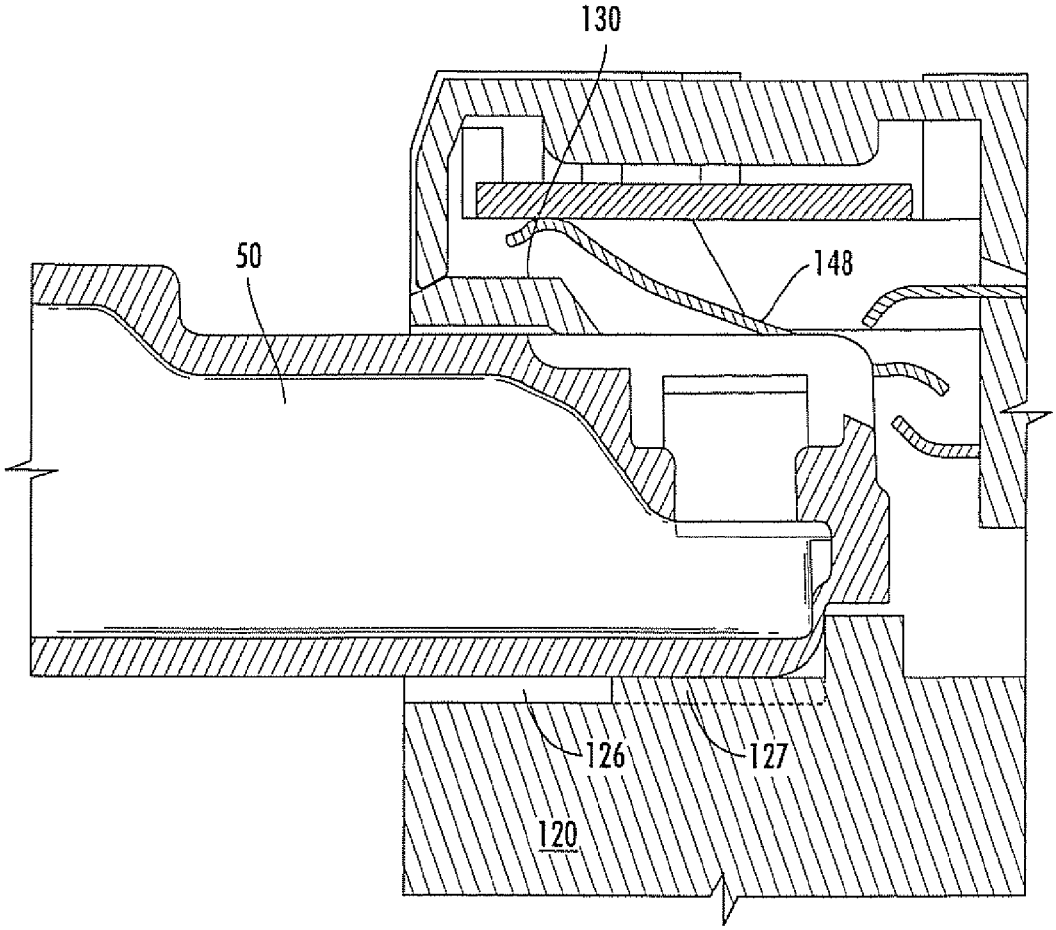
FIG. 9 is a cross-sectional view of the jack frame of the communications jack of FIG. 6 with an RJ-45 communications plug fully inserted into the jack frame.

FIG. 7 is an enlarged perspective view of the jack frame 120 of communications jack 100 of FIG. 6. FIG. 8 is a cross-sectional view of the jack frame 120 of communications jack 100 with an RJ-11 communications plug partially inserted into the jack frame. FIG. 9 is a cross-sectional view of the jack frame 120 of communications jack 100 with an RJ-45 communications plug fully inserted into the jack frame 120. Mechanisms for allowing an RJ-45 communications plug to be fully inserted into the plug receiving cavity 122 of jack frame 120 while preventing RJ-11 communications plugs from being fully inserted into the plug receiving cavity 122 will now be described with respect to FIGS. 7-9.

As shown in FIG. 7, the plug receiving cavity 122 of jack frame 120 has a stepped bottom surface 123-1, 123-2, 123-3 (which is also generically referred to as bottom surface 123 herein), a top surface 124 and a pair of opposed side surfaces 125. The stepped bottom surface 123 of the plug receiving cavity 122 includes three levels 123-1, 123-2, 123-3 that are positioned at three different heights. The lowest level 123-1 of the stepped bottom surface 123 is in the central portion of the plug receiving cavity 122. This lowest level 123-1 is configured to receive the latch of a mating communications plug. An abutment 129 extends upwardly from the lowest level 123-1 of the stepped bottom surface 123. The abutment 129 interfaces with the latch on a mating plug and may assist in holding the plug tight against the latching surface. It will be appreciated that the abutment 129 may be omitted. Notably, when a mating plug is inserted into the plug receiving cavity 122, the latch on the plug enters into the plug receiving cavity 122 through a lower portion 121' of the plug aperture that acts to align the mating plug so that the plug is generally centered between the opposed side surfaces 125 of the plug receiving cavity 122.

As is further shown in FIG. 7, the highest level 123-3 of the stepped bottom surface 123 comprises two separate surfaces 123-3 that are located adjacent the respective opposed side surfaces 125 of the plug receiving cavity 122. The height of the highest level 123-3 may be selected so that the vertical distance "dl" shown in FIG. 7 is set to be slightly larger than the height of the housing of a standards-compliant RJ-45 communications plug so that the RJ-45 communications plug will snugly fit within the plug receiving cavity 122. The middle level 123-2 of the stepped bottom surface 123 comprises a pair of recesses 126 that are cut out of the highest level 123-2 of the bottom surface. The two recesses 126 do not extend into the full depth of the plug receiving cavity 122. As a result, a pair of stops 127 are formed which define the back walls of the respective recesses 126. Herein, the term "stop" refers to a structure that is designed to prevent an RJ-11 communications plug from being fully inserted into the plug receiving cavity 122. The operation of these stops 127 will be described in further detail herein. As will be recognized by those of skill in the art, the bottom surface 123 of jack frame 120 differs from the bottom surface of a conventional RJ-45 jack frame in that it includes the two recesses 126 which in turn define the two stops 127.

As is also shown in FIG. 7, a pair of guides 130, 131 extend into the plug receiving cavity 122 from the top surface 124 of the plug receiving cavity 122. Herein, the term "guide" refers to a structure that directs a mating RJ-11 communications plug in a certain direction when the plug is being inserted into the plug receiving cavity 122. A plurality of walls 133 are provided on a surface 134 that is opposite the top surface 124 of the plug receiving cavity. The walls 133 define a plurality of jackwire contact guide slots 135. As can be seen in FIG. 7, the guides 130, 131 are aligned with respective of the outermost jackwire contact guide slots 135.

FIG. 8 is a cross-sectional view taken through the jack of FIG. 7 along the line defined by the longitudinal (major) axis of guide 130 that illustrates guide 130, one of the stops 127 and how they interact with an RJ-11 communications plug 50 that is inserted into the plug receiving cavity 122 of jack frame 120. As is shown in FIG. 8, the guide 130 may comprise a thin member that extends into the plug receiving cavity 122 that has an angled front surface 130' (i.e., the surface facing the plug aperture 121). As a result of the angled front surface 130', the distal end of guide 130 is farther from the plug aperture 121 than is the base of the guide 130. While the front surface 130' of guide 130 is planar in the particular embodiment depicted in FIGS. 7-9, it will be appreciated that other shapes and configurations may be used in other embodiments. For example, the front surface 130' could be curved, elliptical, etc. in other alternative embodiments. The width of guide 130 is less than the width of the contact slots on a mating RJ-11 or RJ-45 plug (i.e., less than the width of the slots 31'-38' on plug 30 of FIG. 2B). For example, the width of the guide 130 may be less than 0.022 inches. Likewise, the depth of guide 130 (i.e., the distance to which the distal end of the guide 130 extends into the plug receiving cavity 122) is less than the depth of the contact slots on a mating RJ-11 or RJ-45 plug. Guide 131 (which is not visible in FIG. 8) may be identical to guide 130 except for the location where it is mounted on the jack frame 120.

FIG. 9 is a cross-sectional view that shows the positioning of jackwire contact 148 when an RJ-45 communications plug is fully received within the plug receiving cavity 122 of jack frame 120. When the RJ-45 communications plug is inserted into the plug receiving cavity 122, the bottom surface of the housing of the plug comes into contact with the two separate surfaces that comprise the highest level 123-3 of the bottom surface 123 of the plug receiving cavity 122. The RJ-45 communications plug will not enter the recesses 126 because the housing of the RJ-45 plug extends essentially the full width of the plug aperture 121 and hence the bottom surface of the plug housing will ride on the two surfaces 123-3 and hence travel above the recesses 126 so as to contact the top surfaces of the stops 127. Moreover, as discussed above, the width and depth of the guides 130, 131 are configured so that the guides 130, 131 will travel within the contact slots on a mating RJ-45 communications plug. As a result, when an RJ-45 communications plug is inserted into the plug receiving cavity 122, neither the guides 130, 131 nor the stops 127 will inhibit the plug from being fully inserted within the plug receiving cavity 122, as is shown in FIG. 9.

As noted above, the width of an RJ-11 communications plug is less than the width of an RJ-45 communications plug. As discussed above, the lower portion 121' of the plug aperture 121 is designed to snugly receive the latch on a mating plug and hence acts to align any RJ-11 or RJ-45 communications plug that is inserted into the plug receiving cavity 122 such that the plug is generally centered between the opposed side surfaces 125 of the plug receiving cavity 122. The recesses 126 are sized so that their outside edges extend farther from the center of the plug receiving cavity 122 than will the housing of an RJ-11 communications plug that is inserted into the plug receiving cavity 122.

Figure 3A:
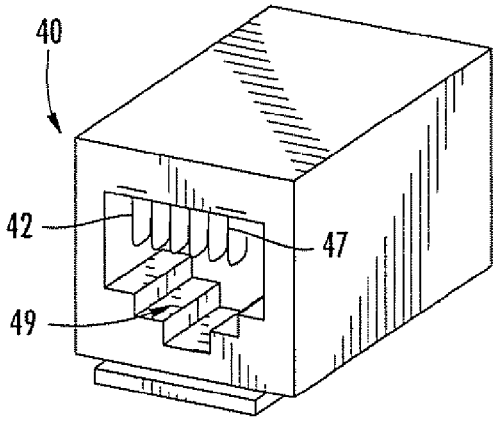
FIG. 3A (PRIOR ART)
FIG. 3A is a simplified perspective view of a conventional RJ-11 communications jack.
Figure 3B:
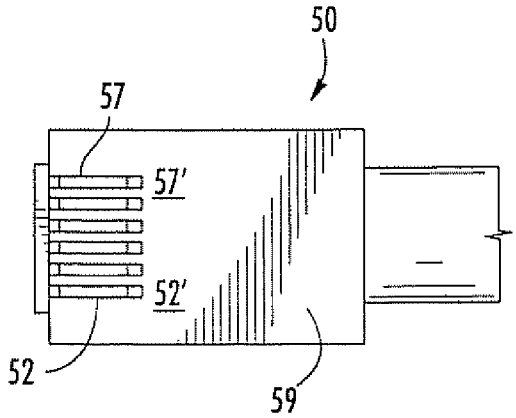
FIG. 3B (PRIOR ART)
FIG. 3B is a simplified plan view of a conventional RJ-11 communications plug.

Turning again to FIG. 8, the behavior of an RJ-11 communications plug that is inserted into the plug receiving cavity 122 of communications jack 100 will now be discussed. As the plug is inserted into the plug receiving cavity 122, the guides 130, 131 contact the leading edge of the plug housing (only guide 130 is visible in FIG. 8). This occurs when an RJ-11 communications plug is inserted, but not when an RJ-45 communications plug is inserted, because, as shown in FIG. 3B, an RJ-11 communications plug does not include contact slots that are aligned with contacts 141 and 148 of jack 100, since RJ-11 communications plugs only have six contacts, whereas RJ-45 communications plugs have eight contacts. As the guides 130, 131 contact the leading edge of the housing of the RJ-11 communications plug, the angled front surfaces of the guides 130, 131 force the plug downward as the plug is inserted further into the jack frame 120. Eventually, the leading edge of the housing of the RJ-11 communications plug is inserted past the guides 130, 131, as is shown in FIG. 8, at which point the bottom surfaces of the guides 130, 131 contact the top surface of the plug housing.

As is apparent from FIG. 8, as the guides 130, 131 force the housing of the RJ-11 communications plug downward, the bottom surface of the plug housing is forced into the recesses 126 that form the middle level 123-2 of the stepped bottom surface 123 of the plug receiving cavity 122. Since the RJ-11 communications plug is narrower than an RJ-45 communications plug, the housing of the RJ-11 communications plug will not come into contact with the two separate surfaces that comprise the highest level 123-3 of the bottom surface 123 of the plug receiving cavity 122, and hence those two surfaces 123-3 will not act to prevent the RJ-11 communications plug from being forced into the recesses 126 as the plug is inserted further into the plug receiving cavity 122. As is also shown in FIG. 8 with respect to one of the recesses 126 and stops 127, as the RJ-11 communications plug is pushed farther into the plug receiving cavity 122, the lower leading edge of the plug housing eventually reaches the back wall of the recesses 126 where it comes into contact with the stops 127. These stops 127 prevent the RJ-11 communications plug from advancing any farther into the plug receiving cavity 122.

As is made clear above, the guides 130, 131 are mounted on the top surface 124 of the plug receiving cavity and are configured to force an RJ-11 communications plug into the pair of recesses 126 that are part of a bottom surface 123 of the plug receiving cavity 122 that is opposite the top surface 124 so that the plug will come into contact with a pair of stops 127 that are likewise located on the bottom surface 123 of the plug receiving cavity 122. The guides 130, 131 force the RJ-11 plug downwardly, away from the contact wires 141-148. As a result of this configuration, even if an RJ-11 communications plug is repeatedly inserted into the plug receiving cavity 122 by mistake, the force that it exerts on the contact wires 141-148 is likely insufficient to permanently deform those contact wires 141-148. The stops 127 may be configured in certain embodiments to only let an RJ-11 communications plug be inserted about halfway into the plug receiving cavity 122. The guides 130, 131 do not prevent the RJ-11 communications plug from entering the plug receiving cavity—in fact, in some embodiments the leading edge of an RJ-11 plug may be inserted past the guides 130, 131, as is shown in FIG. 8. The guides 130, 131, however, do act to direct an RJ-11 plug downward into the recesses 126, thereby causing the RJ-11 communications plug to contact the stops 127 that prevent the RJ-11 communications plug from being fully inserted into the plug receiving cavity 122.

In some embodiments of the present invention, the stops 127 may be substantial structures that extend a significant portion (e.g., 50%) of the depth of the plug receiving cavity 122. As a result, the stops 127 can be quite robust and should not break off or be deformed, even if an individual exerts considerable force in trying to force an RJ-11 communications plug into the plug receiving cavity 122. In addition, in embodiments of the present invention, the guides 130, 131 and stops 127 are fixed structures that are less prone to breaking or malfunctioning than various other mechanisms that have been proposed for solving the "RJ-11 problem" in other prior art references.

Figure 10:
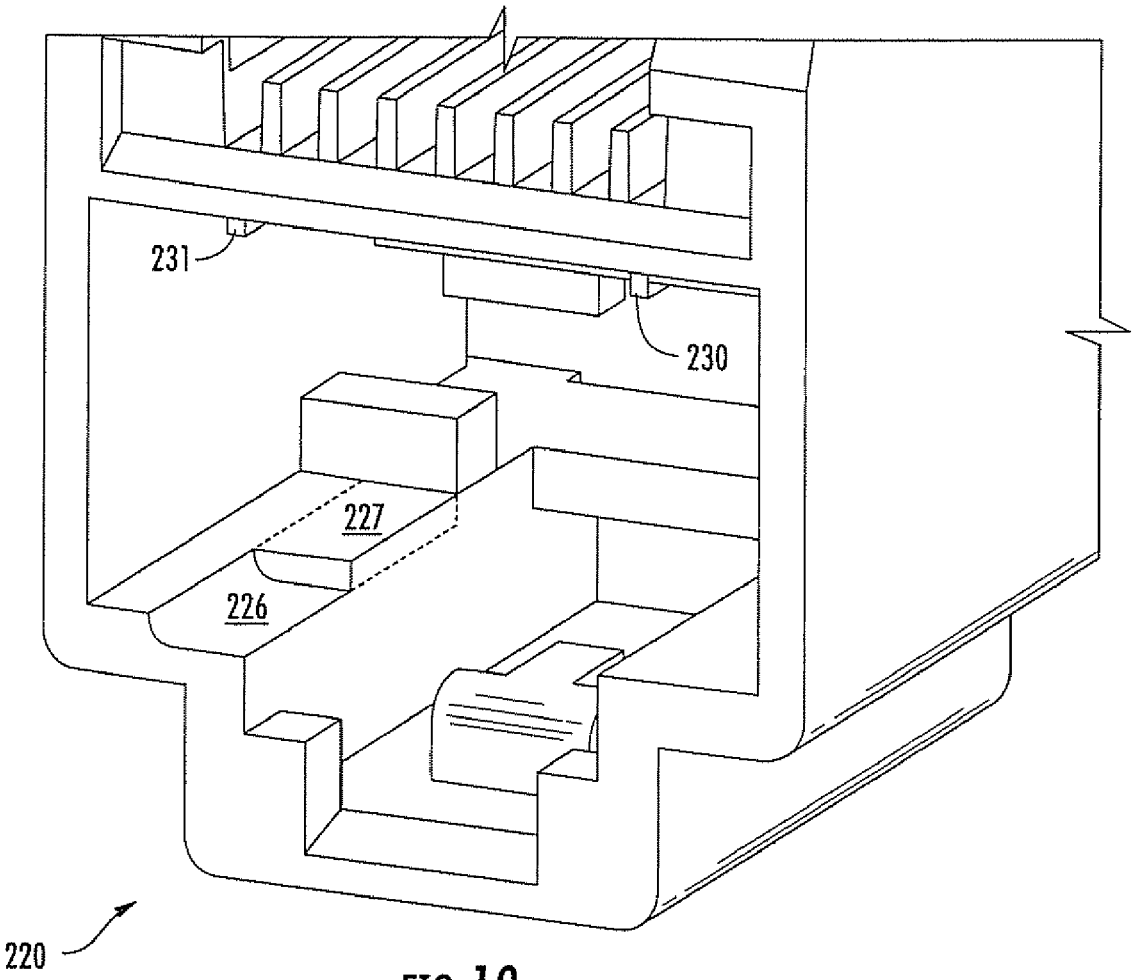
FIG. 10 illustrates a jack frame according to further embodiments of the present invention.

FIG. 10 illustrates a jack frame 220 according to further embodiments of the present invention. Jack frame 220 is substantially identical to jack frame 120 of FIG. 7, except that jack frame 220 includes only a single recess 226 and a single stop 227. It will be appreciated that in embodiments which use a single recess and a single stop, the recess and stop may be located on either the right or left side of the jack frame 220. While the jack 220 includes two guides 230, 231, it will also be appreciated that in other embodiments either guide 230 or guide 231 may be omitted.

Figure 11:
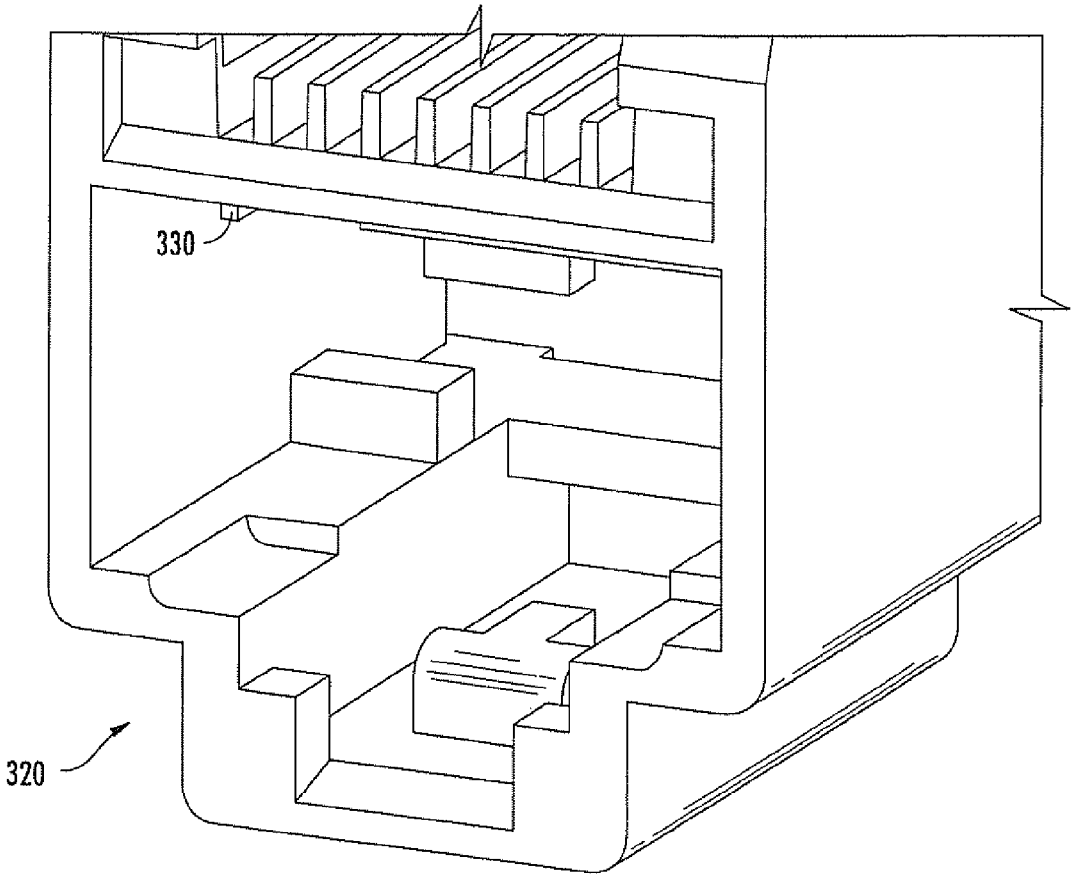
FIG. 11 illustrates a jack frame according to still further embodiments of the present invention.

FIG. 11 illustrates a jack frame 320 according to further embodiments of the present invention. Jack frame 320 is substantially identical to jack frame 120 of FIG. 7, except that jack frame 320 includes only a single guide 330. It will be appreciated that in embodiments which use only a single guide 330, the guide 330 may be located on either the right or left side of the jack frame 320 (i.e., in longitudinal alignment with the plug contact region of either of the outside jackwire contacts).

Figure 12:
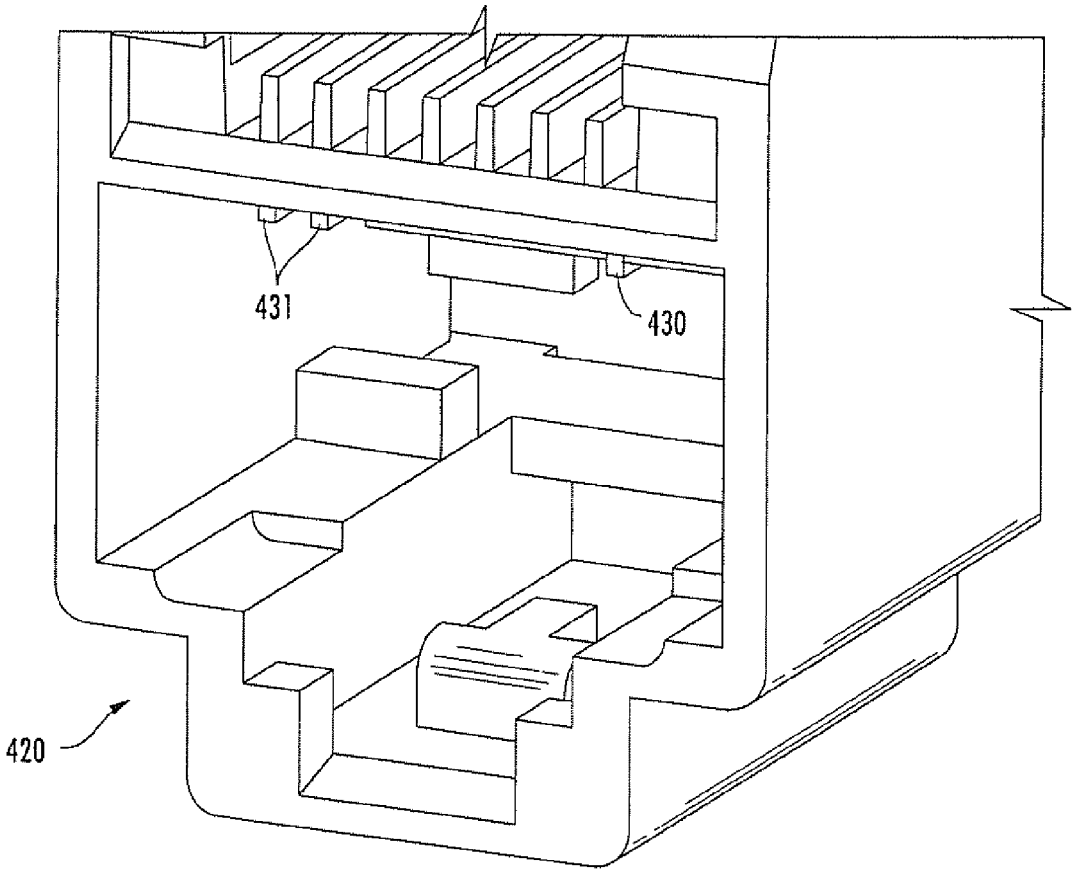
FIG. 12 illustrates a jack frame according to additional embodiments of the present invention.

FIG. 12 illustrates a jack frame 420 according to further embodiments of the present invention. Jack frame 420 is substantially identical to jack frame 320 of FIG. 11 (and includes a single guide 430 that may be identical to the guide 330 of jack frame 320) except that jack frame 420 includes two alignment bars 431 that are positioned in longitudinal alignment with the plug contact region of respective ones of the interior jackwire contacts. The alignment bars 431 may be shaped identically or similarly to the guide 430. Structures 431 are called "alignment bars" as opposed to guides herein because these structures will not act to force or guide the RJ-11 communications plug downwardly, as each alignment bar 431 will instead simply enter one of the contact slots on the plug. This alignment bar 431 may, however, help to reduce or prevent a twisting motion that might otherwise occur when an RJ-11 communications plug is inserted into jack frame 420 since a guide 430 is only provided adjacent one of the two sides of the plug receiving cavity, and hence only one side of the plug is forced in the downward direction. It will be appreciated that up to six alignment bars 431 may be provided in some embodiments, where each alignment bar 431 is longitudinally aligned with the plug contact region of a respective one of the jackwire contacts so that each alignment bar 431 will enter a respective one of the contact slots on a mating RJ-11 or RJ-45 communications plug. It will likewise be appreciated that one or more alignment bars 431 may be provided on any of the other jack frames described herein.

Embodiments of the present invention have been described above with respect to one specific communications jack. It will be appreciated, however, that the illustrated communications jack is exemplary in nature and that the mechanisms for preventing full insertion of an RJ-11 communications plug may be used with respect to any type of RJ-45 communications jack.

It will likewise be appreciated that the guides and stops may be configured differently than shown in the above exemplary embodiments.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An RJ-45 style communications jack, comprising:

a housing having a plug receiving cavity;

a guide protruding from a first surface of the housing into the plug receiving cavity; and a stop provided at a second surface of the housing;

wherein the guide is configured to contact a plug housing of an RJ-11 communications plug when the RJ-11 communications plug is inserted within the plug receiving cavity so that the guide directs the RJ-11 communications plug toward the second surface where the stop prevents the RJ-11 communications plug from being fully inserted within the plug receiving cavity;

wherein the guide comprises a fixed structure;

wherein the guide is configured to be aligned with a contact slot on a mating RJ-45 style communications plug when the mating RJ-45 style communications plug is received within the plug receiving cavity; and wherein a width of the guide is less than a width of a contact slot of the mating RJ-45 style communications plug.

2. The RJ-45 style communications jack of claim 1, wherein the second surface of the housing comprises a surface of the housing that includes an opening that is configured to receive a latch mechanism on the mating RJ-45 style communications plug, and wherein the second surface is opposite the first surface.

3. The RJ-45 style communications jack of claim 1, wherein the guide is positioned to be longitudinally aligned with a first of a plurality of blades of the mating RJ-45 style communications plug and to travel within a first contact slot of the mating RJ-45 communications plug that exposes the first of the plurality of blades when the mating RJ-45 style communications plug is received within the plug receiving cavity.

4. The RJ-45 style communications jack of claim 3, wherein the plurality of blades comprises eight blades that are arranged in a row, and wherein the first of the plurality of blades comprises a blade that is on one end of the row.

5. The RJ-45 style communications jack of claim 1, wherein a surface of the guide that faces a front opening into the plug receiving cavity is configured to engage a leading edge of the plug housing of the RJ-11 style communications plug when the RJ-11 style communications plugs is received within the plug receiving cavity.

6. The RJ-45 style communications jack of claim 2, wherein at least a portion of a surface of the guide that faces a front opening into the plug receiving cavity is angled or curved.

7. The RJ-45 style communications jack of claim 1, wherein the stop comprises a structure that forms a back wall of a recessed region in the second surface.

8. The RJ-45 style communications jack of claim 1, wherein a depth of the guide is less than a depth of the contact slot on the mating RJ-45 style communications plug.

9. The RJ-45 style communications jack of claim 1, wherein the guide is a first guide and the stop is a first stop, and wherein the jack further comprises a second guide that protrudes from the first surface and that is spaced apart from the first guide, and a second stop at the second surface that is spaced apart from the first stop.

10. A RJ-45 style communications jack, comprising:

a housing having a jack frame that has a top wall, a bottom wall and first and second side walls that define a plug receiving cavity;

a fixed, immovable guide extending from an interior surface of the top wall into the plug receiving cavity; and a fixed, immovable stop formed in the bottom wall;

wherein the bottom wall includes a recess that is configured to receive a latch of a mating RJ-45 style communications plug.

11. The RJ-45 style communications jack of claim 10, wherein the guide is configured to contact a leading surface of an RJ-11 communications plug when the RJ-11 communications plug is inserted within the plug receiving cavity and to guide the RJ-11 communications plug into a recess that is adjacent to the stop to prevent the RJ-11 communications plug from being fully inserted within the plug receiving cavity.

12. The RJ-45 style communications jack of claim 10, wherein the guide is positioned to be aligned with one of the two outside contact slots in a row of contact slots provided on an RJ-45 style communications plug when the RJ-45 style communications plug is received within the plug receiving cavity and wherein a width of the guide is less than a width of a contact slot of the RJ-45 style communications plug so that the guide travels within the contact slot when the RJ-45 communications plug is received within the plug receiving cavity.

13. The RJ-45 style communications jack of claim 10, wherein at least a portion of a front surface of the guide that faces a front opening into the plug receiving cavity is angled or curved so that a base of the guide is closer to the front opening than is a distal end of the guide.

14. The RJ-45 style communications jack of claim 10, wherein the bottom wall comprises a stepped surface that has at least three levels, and wherein the stop extends from the middle of the three levels towards the uppermost of the three levels.

15. The RJ-45 style communications jack of claim 14, wherein the height of the stop is less than or equal to the difference in the heights of the middle and uppermost levels of the bottom surface above the lowermost level of the bottom surface.

16. The RJ-45 style communications jack of claim 10, wherein the guide is a first guide and the stop is a first stop, and wherein the jack further comprises a second guide that protrudes from the interior surface of the top wall, the second guide being spaced apart from the first guide, and a second stop that that is formed in the bottom wall, the second stop being spaced apart from the first stop.

17. The RJ-45 style communications jack of claim 16, wherein the interior surface of the bottom wall includes a recessed channel that is configured to receive the latch of an RJ-45 style communications plug, wherein the recessed channel is located between the first and second stops.

18. The RJ-45 style communications jack of claim 10, further comprising an alignment bar extending from the interior surface of the top wall into the plug receiving cavity, wherein the alignment bar is positioned to be aligned with one of the interior contact slots in a row of contact slots provided on an RJ-45 style communications plug when the RJ-45 style communications plug is received within the plug receiving cavity.

19. An RJ-45 style communications jack, comprising:

an RJ-45 style jack frame having a plug receiving cavity;

a first fixed, immovable guide and a second fixed, immovable guide that are spaced apart from each other and that extend from a first interior surface of the jack frame into the plug receiving cavity; and a first recess in a second interior surface of the jack frame that is opposite the first interior surface, wherein a back wall of the recess forms a fixed, immovable stop that is configured to prevent an RJ-11 communications plug from being fully inserted into the plug receiving cavity.

20. The RJ-45 style communications jack of claim 19, wherein at least a portion of a front surface of the first fixed guide that faces a front opening into the plug receiving cavity is angled or curved so that a base of the front surface is closer to the front opening than is a distal end of the front surface.

21. The RJ-45 style communications jack of claim 19, wherein the first and second fixed guides are configured to contact a plug housing of an RJ-11 communications plug when the RJ-11 communications plug is inserted within the plug receiving cavity so that the first and second fixed guides direct the RJ-11 communications plug toward the second surface and into the first recess.

22. The RJ-45 style communications jack of claim 19, wherein the first and second fixed guides each have a width that is less than the width of a contact slot on an RJ-45 style communications plug, and wherein the first and second fixed guides are positioned to be longitudinally aligned with a respective one of the outside contact slots of an RJ-45 style communications plug when the RJ-45 style communications plug is received within the plug receiving cavity.

* * * * *